US010354582B2

(12) United States Patent
Kim

(10) Patent No.: US 10,354,582 B2
(45) Date of Patent: Jul. 16, 2019

(54) DISPLAY DEVICE WITH DEMULTIPLEXER CIRCUIT

(71) Applicant: SAMSUNG DISPLAY CO., LTD., Yongin-si, Gyeonggi-do (KR)

(72) Inventor: Cheol Min Kim, Yongin-si (KR)

(73) Assignee: Samsung Display Co., Ltd., Yongin-Si, Gyeonggi-do (KR)

( * ) Notice: Subject to any disclaimer, the term of this patent is extended or adjusted under 35 U.S.C. 154(b) by 37 days.

(21) Appl. No.: 15/164,923

(22) Filed: May 26, 2016

(65) Prior Publication Data

US 2017/0076665 A1 Mar. 16, 2017

(30) Foreign Application Priority Data

Sep. 10, 2015 (KR) ..... 10-2015-0128621

(51) Int. Cl.
*G09G 3/32* (2016.01)
*G09G 3/3225* (2016.01)

(52) U.S. Cl.
CPC ... *G09G 3/3225* (2013.01); *G09G 2300/0439* (2013.01); *G09G 2310/08* (2013.01)

(58) Field of Classification Search
CPC ..... G09G 3/3225; G09G 2300/0439; G09G 2310/0297; G09G 2310/08
USPC ..... 345/213, 76–107
See application file for complete search history.

(56) References Cited

U.S. PATENT DOCUMENTS

2007/0057877 A1* 3/2007 Choi ..... G09G 3/3233 345/76
2009/0015574 A1* 1/2009 Kim ..... G09G 3/3688 345/208
2009/0225009 A1 9/2009 Ka
2013/0113997 A1* 5/2013 Lee ..... H04N 5/70 348/624
2014/0160172 A1* 6/2014 Lee ..... G09G 3/3607 345/690

FOREIGN PATENT DOCUMENTS

JP 2009-211039 A 9/2009

* cited by examiner

*Primary Examiner* — Stephen G Sherman
(74) *Attorney, Agent, or Firm* — Lee & Morse, P.C.

(57) ABSTRACT

A display device includes a scan driver to supply a scan signal via the scan lines, a data driver to supply data signals via a plurality of source channels, a demux circuit to selectively connect the data lines with the source channels; and a demux controller to control the demux circuit to simultaneously apply the data signals to different data lines between pixels of adjacent columns.

15 Claims, 3 Drawing Sheets

DISPLAY DEVICE WITH DEMULTIPLEXER CIRCUIT

CROSS-REFERENCE TO RELATED APPLICATION

Korean Patent Application No. 10-2015-0128621, filed on Sep. 10, 2015, and entitled, "Display Device," is incorporated by reference herein in its entirety.

BACKGROUND

1. Field

One or more embodiments described herein relate to a display device.

2. Description of the Related Art

A variety of display devices have been developed. Examples include liquid crystal displays, field emission displays, plasma display panels, and organic light emitting display devices. One or more of these types of displays may include a scan driver to supply a scan signal via scan lines and a data driver to supply data signals via data lines. Increasing the resolution of the display device may increase the number of data lines and data driving circuits. This may increase in manufacturing costs.

One approach that has been proposed to reduce the number of data driving circuits involves time-dividing the data signals and then sequentially applying the data signals to data lines using a demultiplexer circuit. Such display device may have a structure in which two data lines are alternately connected to pixels of one column. In this case, the two data lines are adjacent to each other between pixels of two columns.

A driving method proposed for this type of display device involves supplying a data signal to one data line while floating an adjacent data line. A data voltage corresponding to the data signal provided at the previous timing is already stored in the floated data line. In this case, coupling between the adjacent data lines occurs. Thus, the data voltage stored in the floated data line may vary. This may result in deterioration or distortion in image quality.

SUMMARY

In accordance with one or more embodiments, a display device includes a pixel area including pixels connected to scan lines and data lines; a scan driver to supply a scan signal via the scan lines; a data driver to supply data signals via a plurality of source channels; a demux circuit to selectively connect the data lines with the source channels; and a demux controller to control the demux circuit to simultaneously apply the data signals to different data lines between pixels of adjacent columns.

Pixels of one column may be alternately connected to odd-numbered data lines and even-numbered data lines. The demux circuit may include a plurality of demux switches connected between the data lines and the source channels, and the demux circuit may selectively supply the data signals to the data lines through switching operations of the demux switches. The demux controller may generate a plurality of demux control signals to switch the demux switches at different timings.

The demux switches may be connected to the odd-numbered and even-numbered data lines between the pixels of the two adjacent columns are to be switched by a same demux control signal. The data lines connected to the pixels of the even-numbered rows may be electrically connected to the source channels while the scan signal is supplied to the pixels of the odd-numbered rows, and the data lines connected to the pixels of the odd-numbered rows may be electrically connected to the source channels while the scan signal is supplied to the pixels of the even-numbered rows.

The demux control signals may include a first demux control signal to control the demux switches connected to a first pixel group of the pixels of the odd-numbered rows; a second demux control signal to control the demux switches connected to a second pixel group of the pixels of the odd-numbered rows; a third demux control signal to control the demux switches connected to a third pixel group of the pixels of the even-numbered rows; and a fourth demux control signal to control the demux switches connected to a fourth pixel group of the pixels of the even-numbered rows. The third demux control signal and the fourth demux control signal may be sequentially supplied to the demux circuit while the scan signal is supplied to the pixels of the odd-numbered rows, and the first demux control signal and the second demux control signal may be sequentially supplied to the demux circuit while the scan signal is supplied to the pixels of the even-numbered rows.

Each of the first to fourth pixel groups may include red, green, and blue pixels. The pixels may have a pentile matrix structure. The data driver may include a dummy source channel corresponding to one of the data lines. At least one of the first data line or last data line of the data lines may be electrically connected to the dummy source channel via the demux circuit.

In accordance with one or more other embodiments, a display device includes a pixel area including pixels connected to scan lines and data lines; a scan driver to supply a scan signal via the scan lines; a data driver to supply data signals via a plurality of source channels; a demux circuit including a plurality of demux switches to selectively connect the data lines with the source channels; and a demux controller to generate a plurality of demux control signals to switch the demux switches at different timings, wherein odd-numbered and even-numbered data lines are alternately connected to the pixels of one column, and wherein the demux switches connected to the odd-numbered and even-numbered data lines between pixels of adjacent columns are to be switched by a same demux control signal.

In accordance with one or more other embodiments, a controller includes signal lines; and a controller to output a plurality of control signals through the signal lines connected to a demultiplexer, which is to selectively connect data lines to source channels of a display panel, wherein the control signals are to control the demultiplexer to alternately connect odd-numbered and even-numbered data lines to pixels of one column and wherein a same one of the control signals is to control switches of the demultiplexer connected to the odd-numbered and even-numbered data lines between pixels of adjacent columns. The controller may generate the control signals to switch the switches at different timings.

The control signals include a first control signal to control switches connected to a first pixel group of pixels of odd-numbered rows; a second control signal to control switches connected to a second pixel group of pixels of the odd-numbered rows; a third control signal to control switches connected to a third pixel group of pixels of even-numbered rows; and a fourth control signal to control switches connected to a fourth pixel group of pixels of even-numbered rows. The third control signal and the fourth control signal may be sequentially supplied to the demultiplexer while the scan signal is supplied to the pixels of the odd-numbered rows, and the first control signal and the second control signal may be sequentially supplied to the demultiplexer while the scan signal is supplied to the pixels of the even-numbered rows.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
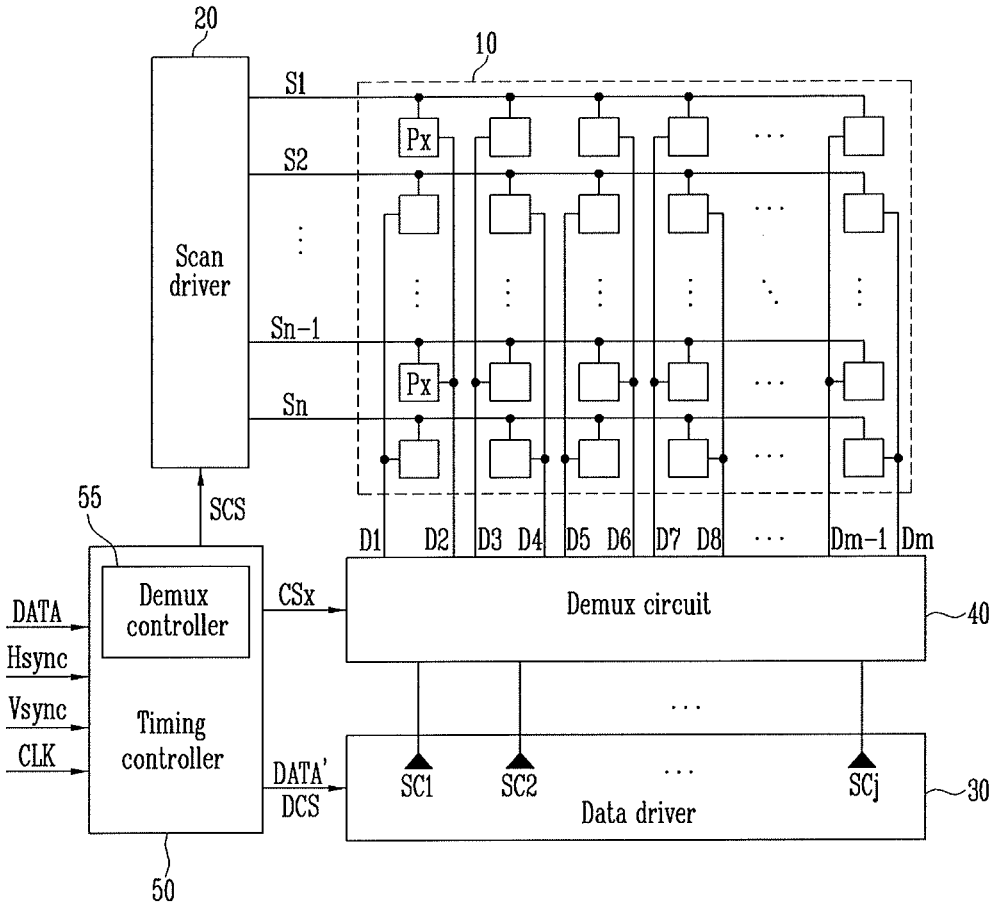
FIG. 1 illustrates an embodiment of a display device.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

FIG. 1 illustrates an embodiment of a display device which includes a pixel area 10, a scan driver 20, a data driver 30, a demultiplexer (demux) circuit 40, and a timing controller 50. The pixel area 10 includes a plurality of pixels Px connected to scan lines S1 to Sn and data lines D1 to Dm and arranged in a matrix form. The pixels Px receive a scan signal via the scan lines S1 to Sn and receive data signals via the data lines D1 to Dm. The pixels Px emit light with luminance corresponding to the data signal supplied via the data lines D1 to Dm when the scan signal is supplied via the scan lines S1 to Sn. In one exemplary embodiment, the pixel area 10 may be an organic light emitting display pane. The pixels Px may have any one of a variety of circuit structures.

The scan lines S1 to Sn are connected to the pixels Px in a row direction. The data lines D1 to Dm are connected to the pixels Px in a column direction. Odd-numbered data lines and even-numbered data lines form a pair to be alternately connected to the pixels of each column. Accordingly, two different data lines are between pixels of adjacent columns. For example, the first data line D1 and the second data line D2 are alternately connected to pixels of a first column. The second data line D2 is connected to pixels of odd-numbered rows in the first column. The first data line D1 is connected to pixels of even-numbered rows in the first column.

In addition, the third data line D3 and the fourth data line D4 are alternately connected to pixels of a second column. The third data line D3 is connected to pixels of odd-numbered row in the second column. The fourth data line D4 is connected to pixels of even-numbered rows in the second column. Accordingly, the second data line D2 and the third data line D3 are between the pixels of the first column and the pixels of the second column that are adjacent to each other.

The scan driver 20 is connected to scan lines S1 to Sn and generates the scan signal in response to a scan driving control signal SCS of the timing controller 50. The generated scan signal is output to the scan lines S1 to Sn. In one exemplary embodiment, the scan driver 20 may include a plurality of stage circuits for sequentially supplying the scan signal to the scan lines S1 to Sn. When the scan signal is sequentially supplied to the scan lines S1 to Sn, the pixels Px may be selected in a row-by-row fashion.

The data driver 30 supplies the data signal via a plurality of source channels SC1 to SCj. The source channels SC1 to SCj are connected to the demux circuit 40. For example, the data driver 30 generates the data signal based on a data driving control signal DCS of the timing controller 50 and image data DATA', and outputs the data signal to the demux circuit 40 via the source channels SC1 to SCj.

The demux circuit 40 is connected between the data driver 30 and the data lines D1 to Dm. The demux circuit 40 selectively connects the data lines D1 to Dm with the source channels SC1 to SCj in response to a demux control signals CSx. In one embodiment, the number of the data lines D1 to Dm is greater than the number of source channels SC1 to SCj. The demux circuit 40 may supply the data signal(s) from the data driver 30 to one or more of the data lines in a first horizontal period, and may supply the data signal(s) to one or more other data lines in a second horizontal period. When the data signals are supplied, data voltages corresponding to the supplied data signals are supplied to the data lines D1 to Dm.

The demux circuit 40 may electrically couple the data lines connected to the pixels of the even-numbered rows with the source channels while the scan signal is supplied to the pixels of the odd-numbered rows. The demux circuit 40 may electrically couple the data lines connected to the pixels of the odd-numbered rows with the source channels while the scan signal is supplied to the pixels of the even-numbered rows. While the scan signal is supplied to the scan line of the i-th row, data signals corresponding to the (i+1)-th row may be supplied.

The timing controller 50 receives image data DATA and synchronization signals Hsync and Vsync and a clock signal CLK for controlling display of the image data DATA. The timing controller 50 image-processes the received image data DATA and generates the image data DATA', which is corrected in accordance with image display of the pixel area 10, for output to the data driver 30. In addition, the timing controller 50 may generate driving control signals SCS and DCS for controlling operations of the scan driver 20 and the data driver 30 based on the synchronization signals Hsync and Vsync and the clock signal CLK. For example, the timing controller 50 generates the scan driving control signal SCS for input into the scan driver 20 and generates the data driving control signal DCS for input into the data driver 30.

The timing controller 50 may include a demux controller 55 for controlling the demux circuit 40. In the current exemplary embodiment, the demux controller 55 and the timing controller 50 are integrated into a single unit. In another exemplary embodiment, the demux controller 55 may be separate from the timing controller 50.

The demux controller 55 generates a plurality of demux control signals CSx for input into the demux circuit 40, and the demux circuit 40 selectively connects the data lines D1 to Dm with the source channels SC1 to SCj. In this case, the demux controller 55 controls the demux circuit 40 such that the data signals are simultaneously applied to different data lines between pixels of adjacent columns. For example, the demux controller 55 may control the demux circuit 40 such that data signals are simultaneously applied to the second data line D2 and the third data line D3 between pixels of the first column and pixels of the second column in the first horizontal period. Further, the demux controller 55 may control the demux circuit 40 such that data signals are simultaneously applied to the fourth data line D4 and the fifth data line D5 between the pixels of the third column and the pixels of the fourth column in the second horizontal period.

Figure 2:
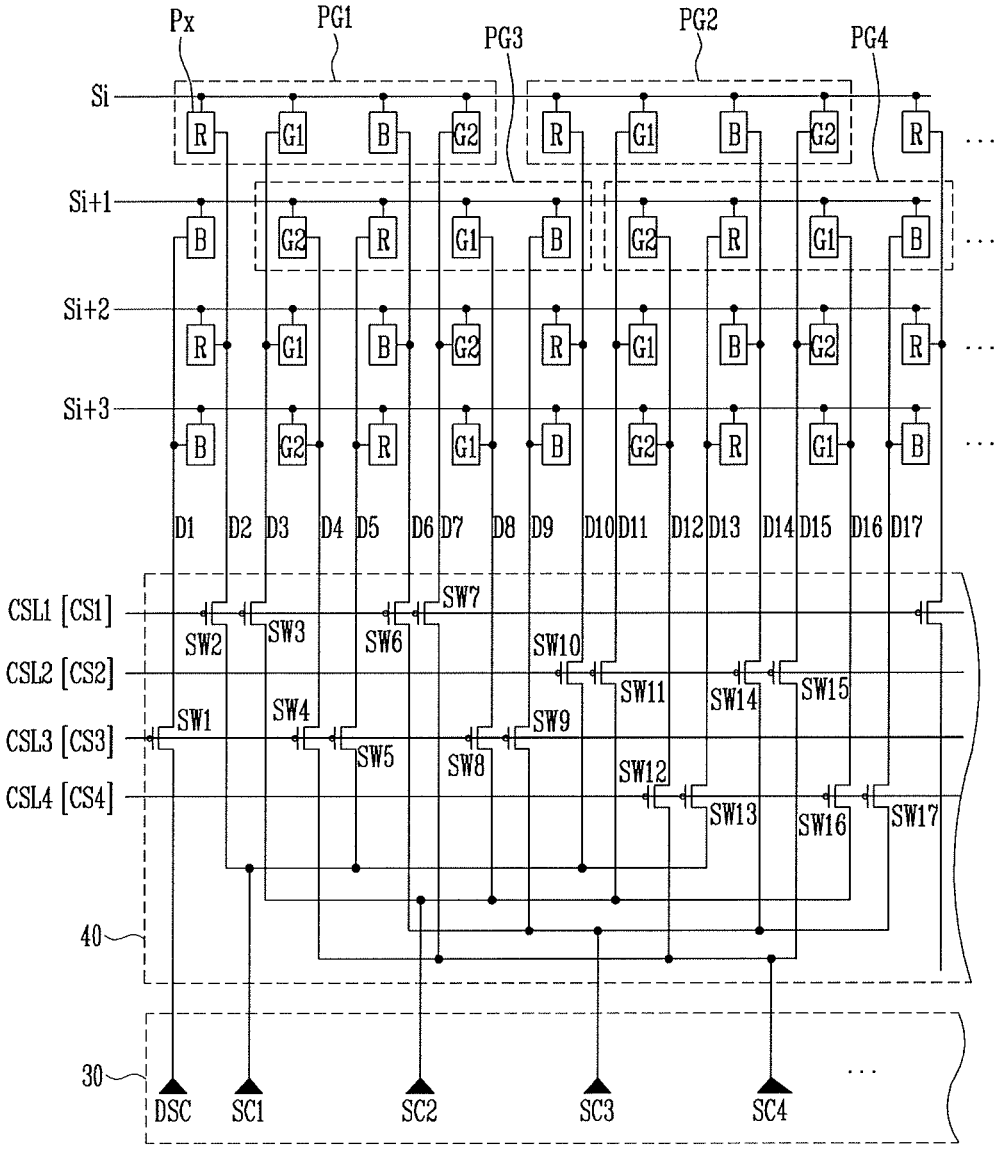
FIG. 2 illustrates an embodiment of a demultiplexer and a data driver.

FIG. 2 illustrates an embodiment of the data driver 30 and demux circuit 40. Referring to FIG. 2, in one embodiment, the pixels Px of the display device have a pentile matrix structure in which red, green, and blue pixels are alternately disposed. For example, the pixels Px may be classified into a red pixel R, a first green pixel G1, a blue pixel B, and a second green pixel G2. The four pixels R, G1, B, and G2 form one pixel group. In addition, odd-numbered rows (i, i+2) and even-numbered rows (i+1, i+3) may have different pixel arrangements and different grouping schemes for the pixel group. The pixels Px of the current exemplary embodiment are grouped such that the even-numbered rows (i+1, i+3) are shifted by one pixel, which is different from the pixel group of the odd-numbered rows (i, i+2). The pixels of the i-th row and the (i+1)-th row and the demux circuit and some of data lines connected to the first to fourth source channels SC1 to SC4 will now be described.

In the current exemplary embodiment, the red pixel R, the first green pixel G1, the blue pixel B, and the second green pixel G2 are sequentially arranged in the i-th row, and the four pixels R, G1, B, and G2 form a first pixel group PG1. In addition, the four pixels R, G1, B, and G2 arranged in the same sequence along the horizontal line form a second pixel group PG2. The first pixel group PG1 and the second pixel group PG2 sequentially emit light for one horizontal period. The blue pixel B, the second green pixel G2, the red pixel R, and the first green pixel G1 are sequentially arranged in the (i+1)-th row, such that they are shifted to the right by one pixel while the blue pixel B is excluded as the first pixel from the pixel group. The second green pixel G2, the red pixel R, the first green pixel G1, and a blue pixel B of the fifth column therefore form a third pixel group PG3. In addition, the four pixels G2, R, G1, and B arranged in the same sequence along the horizontal line form a fourth pixel group PG4. The third pixel group PG3 and the fourth pixel group PG4 sequentially emit light in one horizontal period. The pixel arrangements and the pixel groups described above are repeated in the pixel area 10. The arrangement structure of the pixels Px may be different in another embodiment.

According to the pixel arrangement structure described above, pixels of two different colors are alternately arranged in the pixels of one column. In addition, one pair of the odd-numbered and even-numbered data lines are alternately connected to the pixels of one column. For example, the red pixel R and the blue pixel B are alternately arranged in the pixels of the first column, the first data line D1 is connected to the blue pixel B, and the second data line D2 is connected to the red pixel R.

In the pixels of the second column, the first green pixel G1 and the second green pixel G2 are alternately arranged, the third data line D3 is connected to the first green pixel G1, and the fourth data line D4 is connected to the second green pixel G2.

In the pixels of the third column, the blue pixel B and the red pixel R are alternately arranged, the fifth data line D5 is connected to the red pixel R, and the sixth data line D6 is connected to the blue pixel B.

In the pixels of the fourth column, the second green pixel G2 and the first green pixel G1 are alternately arranged, a seventh data line D7 is connected to the second green pixel G2, and an eighth data line D8 is connected to the first green pixel G1.

The source channels SC1 to SCj of the data driver 30 may be configured to correspond to hues of the pixels Px. In the current exemplary embodiment, the first source channel SC1 may output a red data signal supplied to the red pixels R, the second source channel SC2 may output a first green data signal supplied to the first green pixels G1, the third source channel SC3 may output a blue data signal supplied to the blue pixels B, and the fourth source channel SC4 may output a second green data signal supplied to the second green pixel G2. In addition, the data driver 30 has a structure in which the four arrangement patterns of the source channels are repeated.

In one exemplary embodiment, the data driver 30 may include a dummy source channel DSC that corresponds to any one of the data lines. At least one of the first data line D1 or the last data line Dm of the data lines D1 to Dm may be electrically connected to the dummy source channel DSC via the demux circuit 40. In the current exemplary embodiment, the dummy source channel DSC has a one-to-one correspondence with the first data line D1. The blue pixels B of the first column connected to the first data line D1 is not included in the pixel group. The data driver 30 may include a plurality of dummy source channels DSC that are proportional to the number of the data lines connected to the pixels, which are not included in the pixel group.

The demux circuit 40 includes a plurality of demux switches SW1 to SWm which are connected between the data driver 30 and the data lines D1 to Dm. The demux circuit 40 selectively supplies data signals to the data lines D1 to Dm through switching operations of the demux switches SW1 to SWm. In one embodiment, the number of the demux switches SW1 to SWm may be the same as the number of data lines D1 to Dm and may be greater than the number of source channels SC1 to SCj. The demux circuit 40 may connect the source channels SC1 to SCj with the data lines D1 to Dm based on a predetermined ratio, e.g., a ratio of 1:2, 1:3, 1:4, 1:5 or more. The demux circuit 40 of the current exemplary embodiment connects the source channels SC1 to SCj with the data lines D1 to Dm by a ratio of 1:4. However, since the data driver 30 of the current exemplary embodiment includes the dummy source channel DSC corresponding to the first data line D1, the demux circuit 40 connects the data lines D2 to Dm, except for the first data line D1, with the source channels SC1 to SCj by a ratio of 1:4.

For example, the dummy source channel DSC is connected to the first data line D1 via the first demux switch SW1. The first source channel SC1 is connected to the second data line D2, the fifth data line D5, the tenth data line D10, and the thirteenth data line D13 via the second demux switch SW2, the fifth demux switch SW5, the tenth demux switch SW10, and the thirteenth demux switch SW13, respectively.

The second source channel SC2 is connected to the third data line D3, the eighth data line D8, the eleventh data line D11, and the sixteenth data line D16 via the third demux switch SW3, the eighth demux switch SW8, the eleventh demux switch SW11, and the sixteenth demux switch SW16, respectively.

The third source channel SC3 is connected to the sixth data line D6, the ninth data line D9, the fourteenth data line D14, and the seventeenth data line D17 via the sixth demux switch SW6, the ninth demux switch SW9, the fourteenth demux switch SW14, and the seventeenth demux switch SW17, respectively.

The fourth source channel SC4 is connected to the fourth data line D4, the seventh data line D7, the twelfth data line D12, and the fifteenth data line D15 via the fourth demux switch SW4, the seventh demux switch SW7, the twelfth demux switch SW12, and the fifteenth demux switch SW15, respectively.

The demux controller 55 generates the demux control signals CSx for switching the demux switches SW1 to SWm at different timings. The demux control signals CSx are supplied to the demux switches SW1 to SWm via respective demux control lines. In the current exemplary embodiment, demux control signals CSx includes:

- a first demux control signal CS1 for controlling the demux switches connected to the first pixel group PG1 of the pixels of the odd-numbered rows (i, i+2),
- a second demux control signal CS2 for controlling the demux switches connected to the second pixel group PG2 of the pixels of the odd-numbered rows (i, i+2),
- a third demux control signal CS3 for controlling the demux switches connected to the third pixel group PG3 of the pixels of the even-numbered rows (i+1, i+3), and
- a fourth demux control signal CS4 for controlling the demux switches connected to the fourth pixel group PG4 of the pixels of the even-numbered rows (i+1, i+3).

The first demux control signal CS1 is supplied via a first demux control line CSL1. The second demux control signal CS2 is supplied via a second demux control line CSL2. The third demux control signal CS3 is supplied via a third demux control line CSL3. The fourth demux control signal CS4 is supplied via a fourth demux control line CSL4.

In addition, the demux switches SW1 to SWm connected to the odd-numbered data lines and the even-numbered data lines, positioned between the pixels of adjacent columns, are switched by the same demux control signal. For example, the second data line D2 and the third data line D3 are between the pixels of the first column and the pixels of the second column. A gate electrode of the second demux switch SW2 and a gate electrode of the third demux switch SW3 are connected to the first demux control line CSL1.

The fourth data line D4 and the fifth data line D5 are between the pixels of the second column and the pixels of the third column. A gate electrode of the fourth demux switch SW4 and a gate electrode of the fifth demux switch SW5 are connected to the third demux control line CSL3.

The tenth data line D10 and the eleventh data line D11 are between the pixels of the fifth column and the pixels of the sixth column. A gate electrode of the tenth demux switch SW10 and a gate electrode of the eleventh demux switch SW11 are connected to the second demux control line CSL2.

The twelfth data line D12 and the thirteenth data line D13 are between the pixels of the sixth column and the pixels of the seventh column. A gate electrode of the twelfth demux switch SW12 and a gate electrode of the thirteenth demux switch SW13 are connected to the fourth demux control line CSL4.

Figure 3:
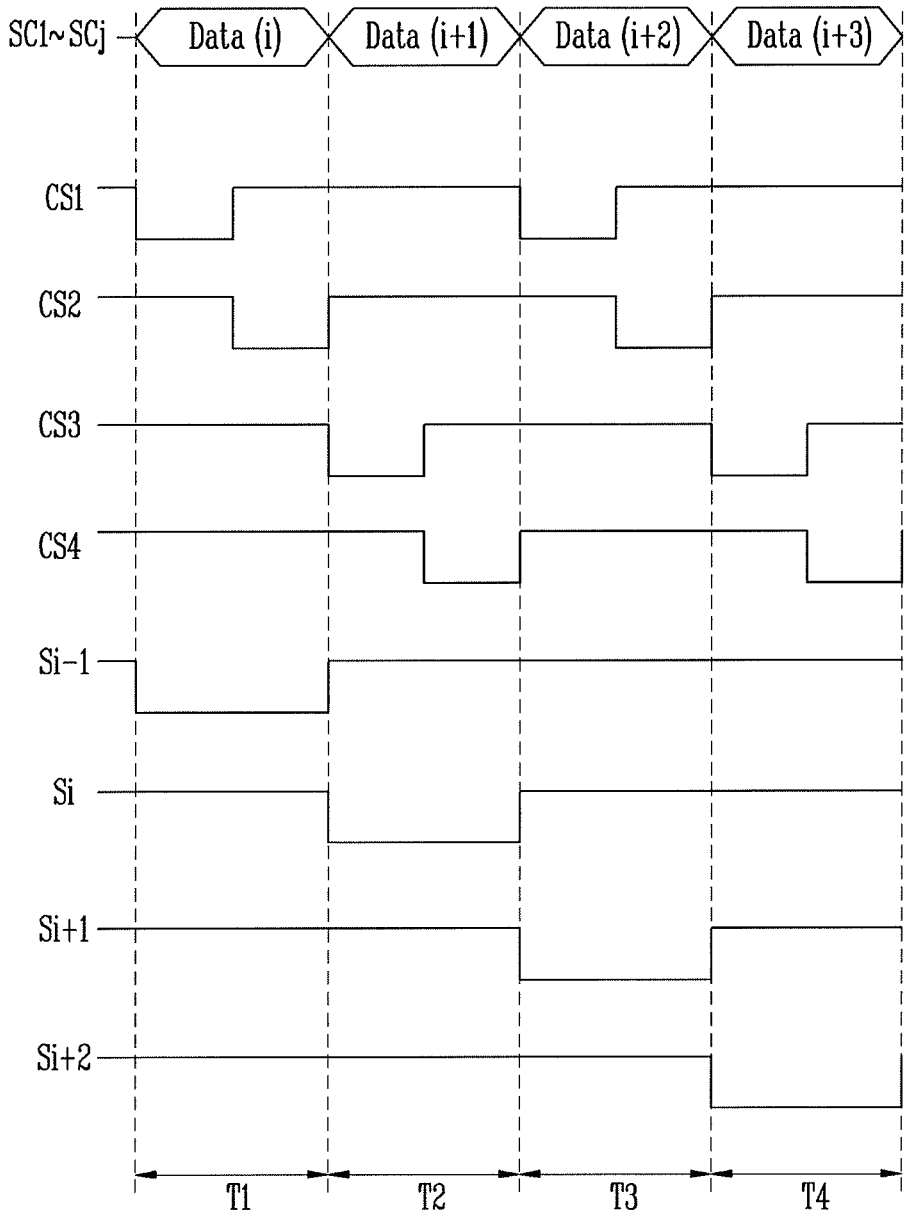
FIG. 3 illustrates an embodiment of a driving method for the display device.

FIG. 3 is a waveform diagram corresponding to one embodiment of a method for driving a display device, which, for example, may be the display device in FIG. 1. Referring to FIGS. 2 and 3, while a scan signal is supplied to pixels of odd-numbered rows (i, i+2), data lines connected to pixels of even-numbered rows (i+1, i+3) are electrically connected to source channels SC1 to SCj. In addition, while the scan signal is supplied to the pixels of the even-numbered rows (i+1, i+3), data lines connected to the pixels of the odd-numbered rows (i, i+2) are electrically connected to the source channels SC1 to SCj.

For example, for a first period T1, the data driver 30 supplies data signals Data(i) corresponding to pixels of the i-th row. In addition, the demux controller 55 sequentially supplies first and second demux control signals CS1 and CS2 of a switch turn-on voltage.

When the first demux control signal CS1 is supplied, second demux switch SW2, third demux switch SW3, sixth demux switch SW6, and seventh demux switch SW7 are simultaneously turned on. When the demux switches SW2, SW3, SW6, and SW7 are turned on, the source channels SC1 to SC4 are connected to second data line D2, third data line D3, sixth data line D6, and seventh data line D7, and the supplied data signal Data(i) is stored in data lines D2, D3, D6, and D7.

When the second demux control signal CS2 is supplied, tenth demux switch SW10, eleventh demux switch SW11, fourteenth demux switch SW14, fifteenth demux switch SW15 are simultaneously turned on. When the demux switches SW10, SW11, SW14, and SW15 are turned on, the source channels SC1 to SC4 are connected to tenth data line D10, eleventh data line D11, fourteenth data line D14, and fifteenth data line D14, and the supplied data signal Data(i) is stored in data lines D10, D11, D14, and D15.

For a second period T2, the data driver 30 supplies data signals Data(i+1) corresponding to pixels of the (i+1)-th row. The demux controller 55 sequentially supplies third and fourth demux control signals CS3 and CS4 of a switch turn-on voltage. In addition, a scan driver 20 supplies a scan signal of a gate-on voltage to the i-th scan line S1.

When the third demux control signal CS3 is supplied, fourth demux switch SW4, fifth demux switch SW5, eighth demux switch SW8, and ninth demux switch SW9 are simultaneously turned on. When the demux switches SW4, SW5, SW8, and SW9 are turned on, the source channels SC1 to SC4 are connected to fourth data line D4, fifth data line D5, eighth data line D8, and ninth data line D9, and the supplied data signals Data(i+1) are stored in the data lines D4, D5, D8, and D9.

In the current exemplary embodiment, a first pixel of the pixels of the (i+1)-th row is connected to the first data line D1. In addition, a dummy source channel DSC is connected to the first data line D1 via the first demux switch SW1 that is switched by the third demux control signal CS3. The dummy source channel DSC supplies data signals Data(i+1) corresponding to the pixels of the (i+1)-th row for the second period T2. Accordingly, when the third demux control signal CS3 is supplied, the dummy source channel DSC is connected to the first data line D1 and a corresponding one of the supplied data signals Data(i+1) is stored in the first data line D1.

When the fourth demux control signal CS4 is supplied, twelfth demux switch SW12, thirteenth demux switch SW13, sixteenth demux switch SW16, and seventeenth demux switch SW17 are simultaneously turned on. When the demux switches SW12, SW13, SW16, and SW17 are turned on, the source channels SC1 to SC4 are connected to twelfth data line D12, thirteenth data line D13, sixteenth data line D16, and seventeenth data line D17 and the supplied data signals Data(i+1) are stored in the data lines D12, D13, D16, and D17.

In addition, since the scan signal of the gate-on voltage is supplied to the i-th scan line S1 for the second period T2, the pixels of the i-th row are connected to the data lines. For the first period T1, the pixels of the i-th row connected to the data lines are supplied with the data signals+Data(i) already stored in the data lines. In this case, the pixels of the i-th row may perform threshold voltage compensation for the supplied data signals Data(i).

For a third period T3, the data driver 30 supplies data signals Data(i+2) corresponding to pixels of the (i+2)-th row. In addition, the demux controller 55 sequentially supplies the first and second demux control signals CS1 and CS2 of a switch turn-on voltage. Operation of the demux circuit 40 by the first and second demux control signals CS1 and CS2 may be identical for the first period T1 and the third period T3. However, data voltages corresponding to the supplied data signals Data(i+2) are stored in the data lines connected to the pixels of the (i+2)-th row.

In addition, since the scan signal of the gate-on voltage is supplied to the (i+1)-th scan line S(i+1) for a third period T3, the pixels of the (i+1)-th row are connected to the data lines. The data signals Data(i+1) stored in the data lines are supplied to the pixels of the (i+1)-th row connected to the data lines for the second period T2. In this case, the pixels of the (i+1)-th row may perform threshold voltage compensation of the supplied data signals Data(i+1).

Next, data signals Data(i+3) corresponding to the pixels of the (i+3)-th row are supplied by the data driver 30 for a fourth period T4. In addition, the demux controller 55 sequentially supplies third and fourth demux control signals CS3 and CS4 of the switch turn-on voltage. Operation of the demux circuit 40 by the third demux control signal CS3 and the fourth demux control signal CS4 may be the same for the second period T1 and the fourth period T3. However, the supplied data signals Data(i+3) are stored in the data lines connected to the pixels of the (i+3)-th row.

In addition, since the scan signal of the gate-on voltage is supplied to the (i+2)-th scan line S(i+2) for a fourth period T4, the pixels of the (i+2)-th row are connected to the data lines. The data signals Data(i+2) stored in the data lines are supplied to the pixels of the (i+2)-th row connected to the data lines for a third period T3. In this case, the pixels of the (i+2)-th row may perform threshold voltage compensation of the supplied data signals Data(i+2).

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The controllers and other processing features of the embodiments described herein may be implemented in logic which, for example, may include hardware, software, or both. When implemented at least partially in hardware, the controllers and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

By way of summation and review, a display device including a demux circuit may have a structure (DCS Demux) in which two data lines are alternately connected to pixels of one column. In this case, data lines adjacent to each other are between pixels of two columns. During driving, while one of the two adjacent data lines is floated, a data signal is supplied to the other data line. The data voltage corresponding to the data signal provided at the previous timing is already stored in the floated data line. In this case, coupling between the adjacent data lines occurs. Thus, the data voltage stored in the floated data line varies, thereby causing deterioration or distortion in image quality.

In accordance with one or more of the aforementioned embodiments, a demux circuit may be controlled such that data signals are simultaneously applied to the different data lines between the pixels of adjacent columns, thereby preventing deterioration and distortion in image quality due to coupling between adjacent data lines.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the embodiments as set forth in the claims.

What is claimed is:

1. A display device, comprising:

a pixel area including pixels connected to scan lines and data lines;

a scan driver to supply a scan signal via the scan lines;

a data driver to supply data signals via a plurality of source channels;

a demux circuit to selectively connect the data lines with the source channels; and a demux controller to control the demux circuit to simultaneously connect a first pair of data lines between pixels of a first pair of adjacent columns to the source channels, and to simultaneously connect a second pair of data lines between pixels of a second pair of adjacent columns to the source channels, wherein the first pair of data lines and the second pair of data lines are connected to the source channels at different timings.

2. The display device as claimed in claim 1, wherein pixels of one column are alternately connected to odd-numbered data lines and even-numbered data lines.

3. The display device as claimed in claim 2, wherein the demux circuit includes a plurality of demux switches connected between the data lines and the source channels, the demux circuit to selectively supply the data signals to the data lines through switching operations of the demux switches.

4. The display device as claimed in claim 3, wherein the demux controller is to generate a plurality of demux control signals to switch the demux switches at different timings.

5. The display device as claimed in claim 4, wherein:

the demux switches connected to a first one of the odd-numbered data lines and a first one of the even-numbered data lines are to be switched by a same demux control signal.

6. The display device as claimed in claim 5, wherein:

the data lines connected to pixels of even-numbered rows are to be electrically connected to the source channels while the scan signal is supplied to pixels of odd-numbered rows, and the data lines connected to the pixels of the odd-numbered rows are to be electrically connected to the source channels while the scan signal is supplied to the pixels of the even-numbered rows.

7. The display device as claimed in claim 6, wherein the demux control signals includes:

a first demux control signal to control the demux switches connected to a first pixel group of the pixels of the odd-numbered rows;

a second demux control signal to control the demux switches connected to a second pixel group of the pixels of the odd-numbered rows;

a third demux control signal to control the demux switches connected to a third pixel group of the pixels of the even-numbered rows; and a fourth demux control signal to control the demux switches connected to a fourth pixel group of the pixels of the even-numbered rows.

8. The display device as claimed in claim 7, wherein:

the third demux control signal and the fourth demux control signal are to be sequentially supplied to the demux circuit while the scan signal is supplied to the pixels of the odd-numbered rows, and the first demux control signal and the second demux control signal are to be sequentially supplied to the demux circuit while the scan signal is supplied to the pixels of the even-numbered rows.

9. The display device as claimed in claim 7, wherein each of the first to fourth pixel groups includes red, green, and blue pixels.

10. The display device as claimed in claim 9, wherein the pixels has a pentile matrix structure.

11. The display device as claimed in claim 1, wherein the data driver includes a dummy source channel corresponding to one of the data lines.

12. The display device as claimed in claim 11, wherein at least one of a first data line or a last data line of the data lines are to be electrically connected to the dummy source channel via the demux circuit.

13. A controller, comprising:

signal lines; and a controller to output a plurality of control signals through the signal lines connected to a demultiplexer, which is to selectively connect data lines to source channels of a display panel, wherein the control signals are to control the demultiplexer to alternately connect odd-numbered and even-numbered data lines to pixels of one column, wherein a same one of the control signals is to control switches of the demultiplexer connected to a first one of the odd-numbered data lines and a first one of the even-numbered data lines between pixels of adjacent columns, and wherein:

the first one of the odd-numbered data lines is adjacent to the first one of the even-numbered data lines between the pixels in the adjacent columns, and the controller is to generate the control signals to switch the switches connected to data lines between pixels in different pairs of the adjacent columns at different timings.

14. The controller as claimed in claim 13, wherein the control signals include:

a first control signal to control switches connected to a first pixel group of pixels of odd-numbered rows;

a second control signal to control switches connected to a second pixel group of pixels of the odd-numbered rows;

a third control signal to control switches connected to a third pixel group of pixels of even-numbered rows; and a fourth control signal to control switches connected to a fourth pixel group of pixels of even-numbered rows.

15. The controller as claimed in claim 14, wherein:

the third control signal and the fourth control signal are to be sequentially supplied to the demultiplexer while a scan signal is supplied to the pixels of the odd-numbered rows, and the first control signal and the second control signal are to be sequentially supplied to the demultiplexer while the scan signal is supplied to the pixels of the even-numbered rows.

* * * * *